United States Patent [19]

McClain

[11] 4,203,414

[45] May 20, 1980

[54] STONE CUTTING APPARATUS

[76] Inventor: Harold F. McClain, 9840 Aberdeen, Leawood, Kans. 66206

[21] Appl. No.: 1,422

[22] Filed: Jan. 8, 1979

[51] Int. Cl.[2] ..... B28D 1/32

[52] U.S. Cl. ..... 125/23 C

[58] Field of Search ..... 125/23 R, 23 C, 230; 51/215 E, 215 CP, 61, 80 A

[56] References Cited

U.S. PATENT DOCUMENTS

| | | | |
|---|---|---|---|
| 2,514,352 | 7/1950 | Solomito | 125/23 |
| 2,552,958 | 5/1951 | Graham | 125/23 |
| 2,753,861 | 7/1956 | Bode | 125/23 |
| 2,768,620 | 10/1956 | Jenkins | 125/23 |
| 2,867,205 | 1/1959 | Vesper | 125/23 |
| 2,881,753 | 4/1959 | Entz | 125/23 |
| 2,882,888 | 4/1959 | Saloga | 125/23 |
| 2,912,970 | 11/1959 | Schlough | 125/23 |
| 3,100,481 | 8/1963 | Stefanick | 125/23 |
| 3,120,842 | 2/1964 | Cox | 125/23 |
| 3,424,144 | 1/1969 | Giconi | 125/23 |
| 3,559,631 | 2/1971 | Mangis | 125/23 |
| 3,677,258 | 7/1972 | Fletcher | 125/23 C |
| 3,809,049 | 5/1974 | Fletcher | 125/23 C |

*Primary Examiner*—Harold D. Whitehead

*Attorney, Agent, or Firm*—Fishburn, Gold & Litman

[57] ABSTRACT

Irregular surfaced slabs of stone are split into blocks of selected width by an apparatus having an upright frame mounted upon a base and with spaced vertical columns connected to opposed upper and lower vertically reciprocal carriages carrying rows of individual power rams each connected to chisels for selected vertical reciprocation relative to the carriage and into engagement with a stone surface. The chisel rams lock into engagement and carriage rams within the columns and on the base move the upper and lower carriages toward each other to split the stone therebetween. Separate hydraulic power units for each carriage and the chisels carried thereon are connected via electrical circuits to a central unit for regulating operation of the apparatus. An upper hydraulic power fluid unit is mounted to the upper carriage for movement therewith and includes a motor driving power fluid pumps and having a reservoir integral with the upper carriage. Centering rams extend inwardly from each column and are operable in combination with a gauging bar assembly mounted on the upper carriage to selectively position the stone for cutting. In-feed and discharge conveyors are respectively positioned for travel of the stone slabs thereon and turntable, walker beam arrangements, and discharge flippers assist handling the stone slabs.

18 Claims, 15 Drawing Figures

STONE CUTTING APPARATUS

This invention relates to a guillotine cutter or machine in which upper and lower carriages having chisels mounted thereon cut or split the stone into blocks of selected width.

During quarrying operations slabs of stone favored for building masonry material such as granite, quartzite, sandstone, dolomite or dolostone, and limestone are removed from a rock working quarry face and commonly have very irregular top and bottom surfaces. Irregular surfaces, along which the stone naturally splits into horizontally elongate slabs as a result of bedding plane or joint separation, often present a rough exterior characterized by sloping surfaces and projections extending outwardly, for example, from two to five inches or even more.

For such a stone slab to be split properly and into blocks having an elongate, vertical face suitable for building masonry or veneer work, the chisels or teeth of rock splitting machines must engage the irregular surface in a vertical plane and each chisel must exert even pressure relative to the other chisels. If one or more of the chisels does not press downwardly on the stone with force equal to that of the other chisels, the stone will not split evenly therebetween to form a vertical face but instead will form an irregularly split surface.

This problem of evenly splitting a stone has been addressed by many, a common solution being to employ wedge shaped adjusting blocks permitting individual chisels to be retracted or lowered in accordance with the contour of an irregular surface against which the set of chisels is applied. A difficulty arising with these machines is that typically the wedges thereof only operate to position the chisel cutting edge against the stone surface whereupon the wedge is locked into position preparatory to cutting the stroke of the carriage. Because many stone slabs have weathered surfaces which are substantially less solid than the underlying stone body and may have relatively soft shale or mud tenaciously adhering to low portions of the irregular surface, the wedge adjusted chisels typically set aginst non-solid material and cutting pressure exerting by the chisels is thereby often not uniform against the body of the stone, resulting in irregular splits and waste material, and thus increasing the cost of stone cutting in general.

The principal objects of the present invention are: to provide a stone splitting apparatus wherein individually mounted and separately reciprocal chisels are mounted on upper and lower carriages; to provide such an apparatus wherein upper and lower carriages are movable toward each other for stone splitting action; to provide such an apparatus having a plurality of chisels which are brought into engagement of predetermined pressure with opposed sides of a stone slab and by a separate step subsequently cause the stone slab to split transversely of the bedding plane layers; to provide such an apparatus wherein individual chisels are locked into position relative to an irregular surface of a stone and movable thereagainst while conforming to their respective locked positions; to provide such an apparatus having a walker beam structure operable to selectively move stone slabs forwardly and rearwardly for proper splitting position; to provide such an apparatus having centering rams extending outwardly from support columns of the apparatus for locating a stone slab with respect to center chisels of the apparatus; to provide such an apparatus having a gauging structure located rearwardly of the chisels for controlling the extent of a stone slab positioned between the chisels; to provide such an apparatus having a flipper structure located rearwardly and adjacent to the lower carriage chisels for urging split stone slabs onto a discharge conveyor; to provide such an apparatus wherein rams for upper and lower carriages and chisels mounted respectively thereon are powered by separate hydraulic systems; to provide such an apparatus wherein hydraulically powered components of an upper carriage are located thereon, thereby permitting relatively short runs of power fluid lines for a minimum of leakage and possible line rupture; to provide such an apparatus wherein hydraulically powered components and valve arrangements are arranged to cause the upper and lower carriages to quickly cease cutting action upon splitting of the stone slab; to provide such an apparatus having hydraulically powered upper and lower carriage rams arranged to move in coordination with each other and with cumulatively equal rates of movement and pressures; to provide such an apparatus having hydraulic systems thereof arranged for rapid rate of movement of the upper and lower carriages to position the chisels thereof against the stone slab preparatory to splitting the stone; to provide such an apparatus having a relatively slow rate of movement of the upper and lower carriages during actual splitting operation; and to provide such an apparatus which is sturdy and efficient in use and particularly well adapted for the intended purpose.

Other objects and advantages of this invention will become apparent from the following description taken in connection with the accompanying drawings wherein are set forth by way of illustration and example, certain embodiments of this invention.

Figure 1:
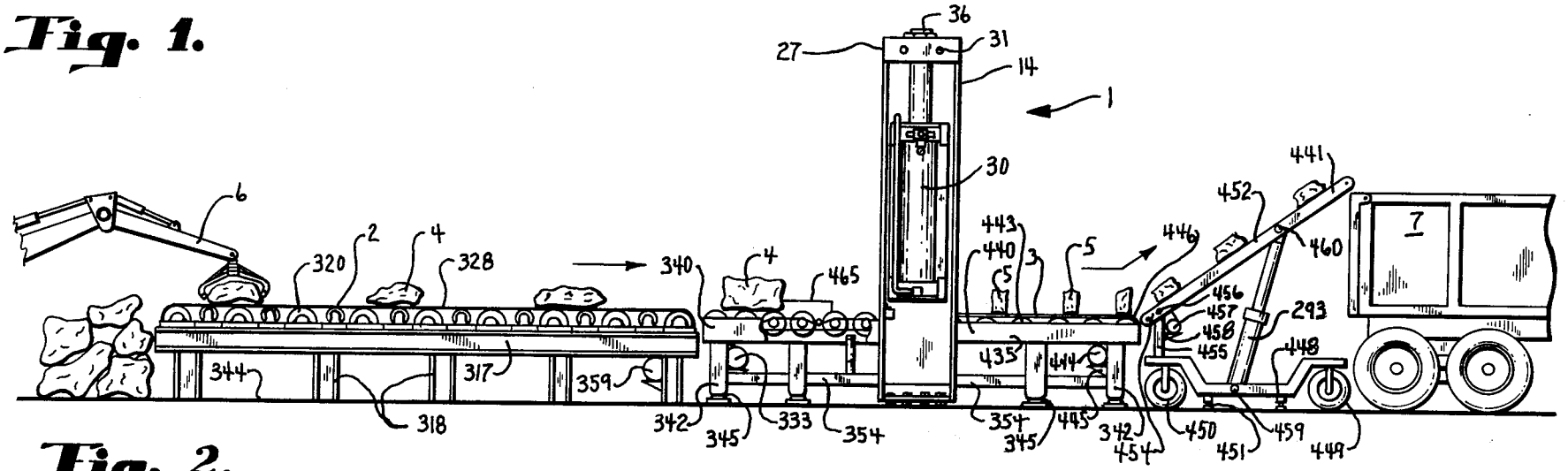
FIG. 1 is an overall side elevational view of a stone splitting apparatus embodying the present invention and having in-feed and discharge conveyors respectively receiving irregularly surfaced stone slabs and cutting therefrom blocks of stone material suitable for masonry work.

Referring to the drawings in more detail:

As required detailed embodiments of the present invention are disclosed herein, however, it is to be understood that disclosed embodiments are merely exemplary of the invention which may be embodied in various forms, therefore, specific structural and functional details disclosed herein are not to be interpreted as limiting, but merely as a basis for the claims and as a representative basis for teaching one skilled in the art to variously employ the present invention in virtually any appropriately detailed structure.

The reference numeral 1 generally indicates a stone cutting or splitting apparatus embodying the present invention. Located on opposite front and rear sides of the stone splitting apparatus 1 are an in-feed conveyor 2 and a discharge or out-flow conveyor 3 which transport quarried stone blocks or slabs 4 toward the stone splitting apparatus 1 and, after cutting or splitting thereof, transport the split blocks of building stone or veneer 5 therefrom. As illustrated in FIG. 1, the quarried stone blocks or slabs 4 are placed upon the in-feed conveyor 2 by means such as a lifting arm 6 and conveyed to a reversable conveyor portion and then maneuvered by the conveyor walkers and lateral pushers to properly center the stone slab in a cutting position with a leading edge against an adjustable stop arranged for desired width of stone cut. After being positioned, chisels engage the stone slab, the stop is removed and then the splitting apparatus operated to effect the cut of the stone for venner blocks. After being cut, the cut piece is moved by the discharge conveyor and loaded into trucks 7 for transport to the job site or arranged in stacks for later use. The stone splitting apparatus 1 is preferably located within a building or suitable enclosure structure (not shown) for protection from adverse weather.

The stone splitting apparatus 1 is massive in structure and is preferably securely mounted to a floor of material such as concrete having sufficient strength to withstand the weight of the apparatus 1. The apparatus 1 includes a sturdy base 10, FIG. 3, such as of steel plate or the like, secured at intervals to the floor by suitable fasteners such as J-bolts 11 with upper and lower nuts 12 adjustable thereon for leveling the base 10 relative to the floor.

Spaced upright columns 13 and 14 are affixed normally to the base 10 and have the stone splitting components of the apparatus located therewith. The upright column 13 and 14 provide means (described below) movably mounting an upper carriage 15 therebetween for vertical reciprocation toward and away from a lower carriage 16 having corresponding movement in the manner of a double acting guillotine for splitting the stone slabs 4 therebetween.

The upright columns 13 and 14 each include front and rear side walls 18 and 19 and inner end walls 20 in right angular arrangement. The inner end wall 20 has a lower portion 22 extending between the margins of the front and rear side walls 18 and 19 and has spaced upper portions 23 and 24 with an opening 25 therebetween communicating with the interior of the column. Bottom margins of the front and rear side walls 18 and 19 and the inner end wall 20 are secured to the base 10, as by welding, for mounting of the columns 13 and 14. An elongated plate member 27 respectively extends across the upper portion of the columns 13 and 14 and thick plates or hanger members 28 having marginal dimensions corresponding to the inside dimensions of the columns and of sufficient strength to withstand heavy loads are mounted, as by bolts 31, within respective upper ends of the columns 13 and 14. Bores 29 extend vertically through the centers of the hanger members 28 for suspending mounting portions for the upper carriage 15.

In the illustrated example, the upright columns 13 and 14 have dual-acting carriage rams 26 and 30 respectively reciprocally mounted therein. The carriage rams 26 and 30 each include a cylinder 32, for example of 12 inches in diameter, and having extension and retraction end caps 33 and 34 and a piston shaft 35 with a free end 36 extended through the hanger member bore 29 and affixed by a suitable fastener such as a nut 37. The carriage rams 26 and 30 are thereby suspended within the upright columns 13 and 14, the upper carriage 15 in turn being affixed to the respective carriage rams 26 and 30 for reciprocatory movement therewith as described below. Each carriage ram 26 and 30 includes upper and lower ear members 40 and 41 suitably mounted to respective retraction and extension cylinder end caps 34 and 33. A vertically elongate plate member 42 extends between the ear members 40 and 41 and parallels the respective carriage rams 26 and 30. Upper and lower guide ways 43 and 44 mounted on an inward side of the plate member 42 slide against the interior surfaces of the spaced upper portions 23 and 24 of the column.

Opposite ends 47 and 48 of the upper carriage 15 are connected to the respective elongate plate members 42 of the upright columns 13 and 14. In the illustrated example, the upper carriage 15 includes a horizontal main beam 49, FIG. 5, such as an I-beam having wide flanges and enclosed by front and rear walls 50 and 51. Opposite ends of the main beam 49 are secured to the elongate plate member 42 as by welding, and the walls 50 and 51 form a power fluid holding reservoir 52 integral with the upper carriage 15. Further, a web 53 of the main beam 49 has a plurality of ports 54 therethrough for circulation of fluid throughout the reservoir 52.

Extended downwardly from a bottom flange 56 of the main beam 49 and substantially from opposite ends 47 and 48 thereof are a plurality of side-by-side dual acting chisel rams 58 respectively having a cylinder 59, for example of 5 inches in diameter, and with extension and retraction end caps 60 and 61 with an extensible and retractable piston shaft 62 therein. The extension end cap 60 is affixed to the bottom flange 56 as by bolts 63 for ease of removal and replacement of a chisel ram 58. A stone engaging removable and replaceable hardened tip or chisel 63 is, for example, threadably connected to a free end 64 of the piston shaft 62. Angular cover guards 66 extend over the lower ends of the chisel rams 58 and are connected to horizontally elongate brackets 66 affixed to the retraction end caps 61. The cover guards 66 include apertures 68 through which respective piston shafts 62 extend.

It is preferred that there be an odd number of chisels with one centered and the others spaced laterally outwardly thereof with the next outward chisels from the center being paired. In the illustrated structure eleven such chisels rams 58 extend along the bottom of the upper carriage 15 and are respectively associated with indicia plates 69 respectively bearing the indicia 1 and indicia 2 through 6 arranged in pairs thereof and identifying the spaced chisel rams 58 to the operator. The indicia plates 69 are arranged in pairs on opposite or left and right sides of a center chisel ram 70, FIG. 3, in serially progressing order, the single center chisel ram 70 having the indicia 1 thereover. Each chisel ram 58 has power fluid conduits connected thereto and extending to a source thereof as described below.

Figure 9:
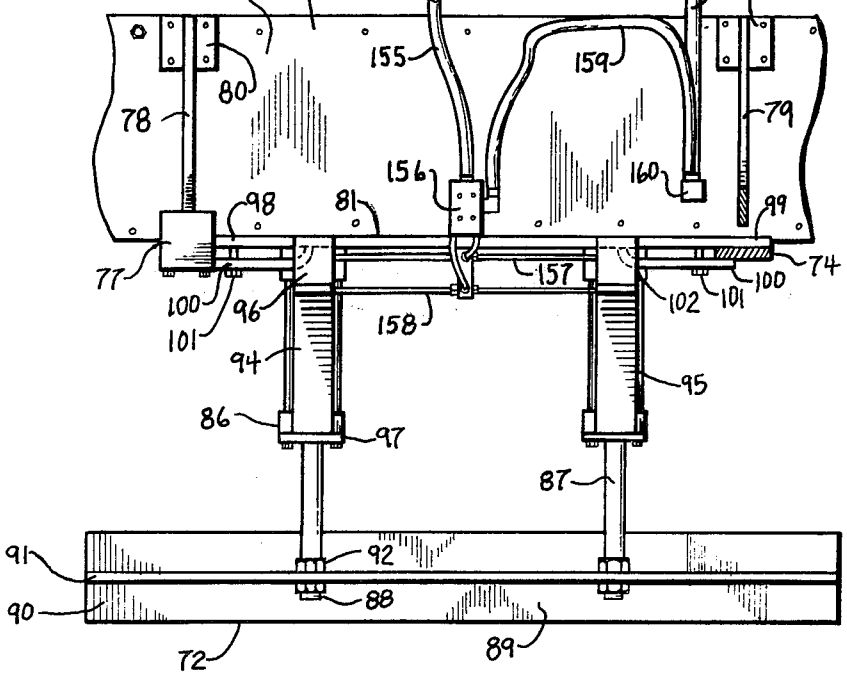
FIG. 9 is a fragmentary enlarged view of a material gauging structure mounted upon a rear side of the stone splitting apparatus.

On the rearward side of the upper carriage 15 is a material stop or gauging bar structure 72 for selectively controlling the extent of a stone slab 4 positioned for cutting between the upper and lower carriages 15 and 16. The exemplary gauging bar structure 72, FIGS. 4, 5 and 9, has spaced horizontal bars 73 and 74 extended outwardly of the upper carriage 15 and respectively have inner ends 75 connected to the main beam bottom flange 56 as by bolting. An outer end 76 is connected to a right angle bracket 77 to which are respectively fitted spaced, supportive arms 78 and 79 each extending between the bracket 77 and a plate member 80 adjacent an upper edge of the carriage rear wall 51. A horizontal beam member 81 is movably supported by and between the outward extending horizontal bars 73 and 74 for forward and rearward sliding. Spaced apart, vertical rams 82 and 83 depend from the beam member 81 adjacent each horizontal bar 73 and 74.

The rams 82 and 83 respectively include a cylinder 84 with extension and retraction end caps 85 and 86 and arranged to mount the extension end caps 85 to the underside of the beam member 81. Respective piston shafts 87 are reciprocable from the cylinders 84 and shaft free ends 88 are connected to a horizontal web portion 91 of a bar member 89 including a vertical, relatively wide face or flange 90 to stop movement of the stone slab 4. The piston shaft free ends 88 extend through bores in the web portion 91 and are secured thereto, as by nuts 92. For support, spaced braces or arms 94 and 95 extend between lower ends of the cylinder 84 and the rearward edge of the beam member 81. In the illustrated example, the upper end of each brace or arm 94 and 95 is connected to a right angle bracket 96 on the beam member 81 and the lower end mounted to a plate member 97 on the ram retraction end cap 86. Opposite ends 98 and 99 of the beam member 81 have clamping structures to control sliding on the horizontal bars 73 and 74 such as a bar 100 frictionally engaging the underside of each horizontal bar 73 and 74 and selectively tightenable thereagainst, as by bolt 101. An opposite end portion 102 of the bar 100 is curved upwardly and against the underside of the beam member 81 to provide a rocking surface for engagement. As described below, the rams 82 and 83 include power fluid conduits and valve means.

The upper and lower carriages 15 and 16 preferably have separate hydraulic power fluid systems providing relatively short runs of line or conduit and requiring few sections of flexible conduit, thereby minimizing possibility of leakage. Referring to FIGS. 3, 4, 5 and 13, mounted atop the upper carriage main beam 49 is an electric motor 105 having a cord or line 106 connected to a source of electrical power as described below. The motor 105, by a shaft (not shown) within a housing 107 drives a low pressure, high volume hydraulic power fluid pump 109 and a high pressure, low volume hydraulic power fluid pump 110, the pumps 109 and 110 having integrated hydraulic lines or conduits as described below providing power fluid for the carriage rams 26 and 30, the eleven chisel rams 58 and the gauging rams 82 and 83.

Preferably, the low pressure, high volume pump 109 provides fluid pressurized at up to for example, 500 psi at 30 gallons per minute (gpm) and the high pressure, low volume hydraulic power fluid pump 110 supplies fluid at up to for example, 2650 psi at 8 gpm. The respective pumps 109 and 110 draw hydraulic fluid from the reservoir 52 through a main fluid supply line 111 and a filter 112 and then via supply lines 113 to the pumps 109 and 110. Fluid from the low pressure, high volume pump 109 flows through a power line 108 with a solenoid controlled relief valve structure 114 connected thereto and internally having a spring-loaded relief valve 115 therein providing pressure control to 500 psi and lines 115' extending from opposite sides of the valve 115 respectively to a valve entry line and a dual solenoid actuated, three position, spring centered, directional control valve 116. The directional control valve 116 is preferably energized to a closed position whereby fluid from the pump 109 does not pass through the valve structure 114 and is thereby routed to the various operating rams described below. When open, fluid passes through the valve 116 and to an external spring actuated relief valve 117 providing pressure control to 75 psi. A pilot mechanism 117' extends from the valve 117 for control. When the valve 114 is energized closed, fluid from the pump 109 flows through the line 108 and through a pressure actuated ball and seat, mechanical, one-way, check valve 120 which for example, opens when the power line pressure reaches approximately 250 psi.

Similarly, fluid from the high pressure, low volume pump 110 flows through a power line 127 to a valve structure 132 internally having a spring-loaded relief valve 133 with port lines 133' returning to the power line 127 and extending to a single solenoid actuated, two position, spring-offset directional control valve 134 within the valve structure 132 and having integral adjustment for maintaining a preset range of line pressure. The directional control valve 134, sensing the fluid pressure through a pilot port 133', is normally closed and accordingly, the valve 133 is denergized open, permitting fluid to flow through the valve structure 132 and via a return line 135 to the reservoir 52. When the valve structure 132 is energized closed, fluid from the high pressure, low volume pump 110 flows through the power line 127 to a pressure actuated, ball and seat mechanical, one way check valve 137, preferably set to open at 250 psi. Thus, fluid from the pumps 109 and 110 flows into a common power manifold or line 136 which is connected directly to a power line 119 leading to control valves for the chisel rams 58 and the gauging rams 82 and 83.

The common manifold or line 119 also leads to a dual solenoid actuated, spring centered, three position, fair connection directional control valve 121 having a drain connection and a pilot pressure line 121' extending therefrom to the power line 127 forwardly of the mechanical check valve 137 for sensing fluid pressure differentials relative to the line 127 and actuating the valve thereby for positioning the flow directing element in the valve 121 by solenoid, spring or pilot function. Extension and retraction lines 122 and 123 are connected to the directional control valve 121 and lead to the carriage rams 26 and 30.

Interposed in the retraction lines 123 adjacent the respective carriage rams 26 and 30 are counterbalance-type holding valve structures 124 each having a spring biased relief valve 125 internally with a pilot pressure port 124' and a pilot pressure port 125'. The pilot pressure ports 124' and 125' are each connected to the retraction line 123 on opposite sides of the valve 125, the pilot pressure port 124' being connected to the line 123 before a one way ball and seat mechanical check valve 126 with integral adjustment preferably set to open at 250 pounds. The counterbalance holding valve structure 124 is opened upon sensing pressure over 250 pounds in the retraction line 123 and is thereby open for all normal operation. When fluid output ceases, as when the motor 105 is turned off, fluid pressure becomes greater on the ram side of the extension line 123 than on the pump side of the extension line 123, thereby causing the spring in the valve 125 to move the valve flow directing element and move internal fluid ports from registration. The check valve 126 closes, thereby preventing fluid flow and maintaining the carriage rams 26 and 30 in the position, or degree of extension that they were in at the time of motor shut down.

The upper carriage rams 26 and 30 operate to split the stone slab 4 when the ram extends and fluid from the lines 122 travels back through the directional control valve 121 into a return line 128 having a filter 129 thereon and connected to the reservoir 52 by a line 130.

Figure 3:
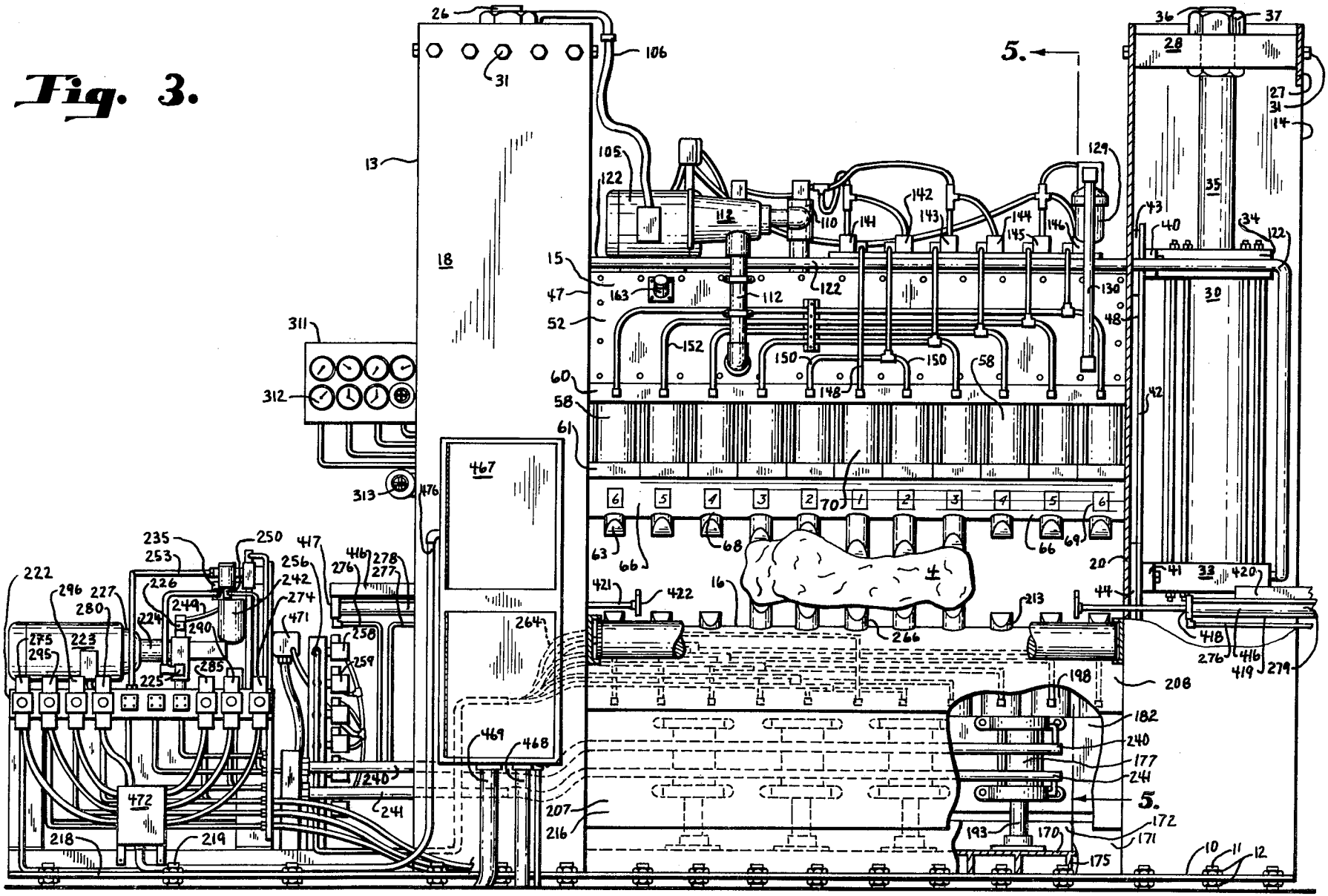
FIG. 3 is an elevational view of a front side of a stone splitting apparatus and showing portions thereof broken away for purposes of illustration.
Figure 4:
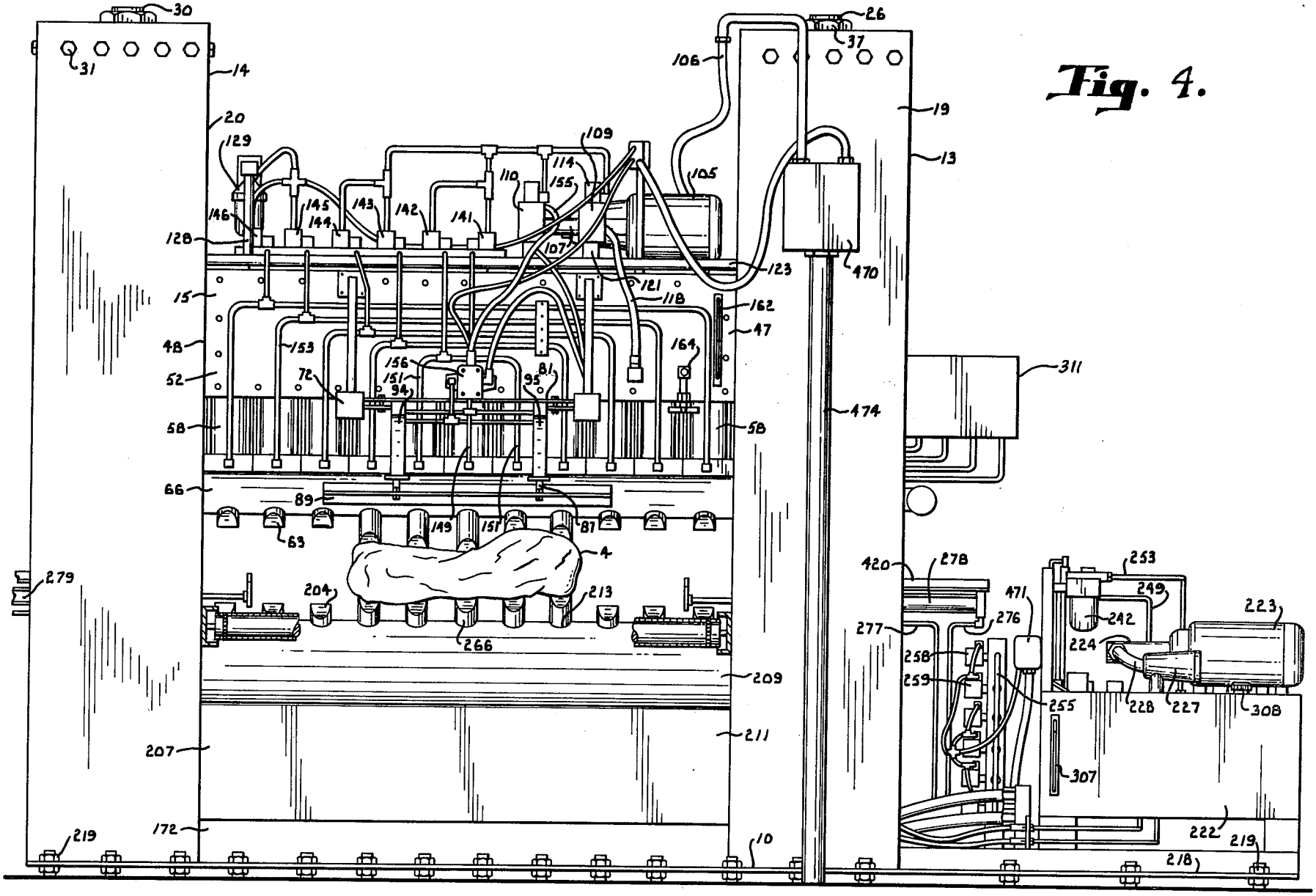
FIG. 4 is an elevational view of a rear side of the stone splitting apparatus and showing portions thereof broken away.
Figure 5:
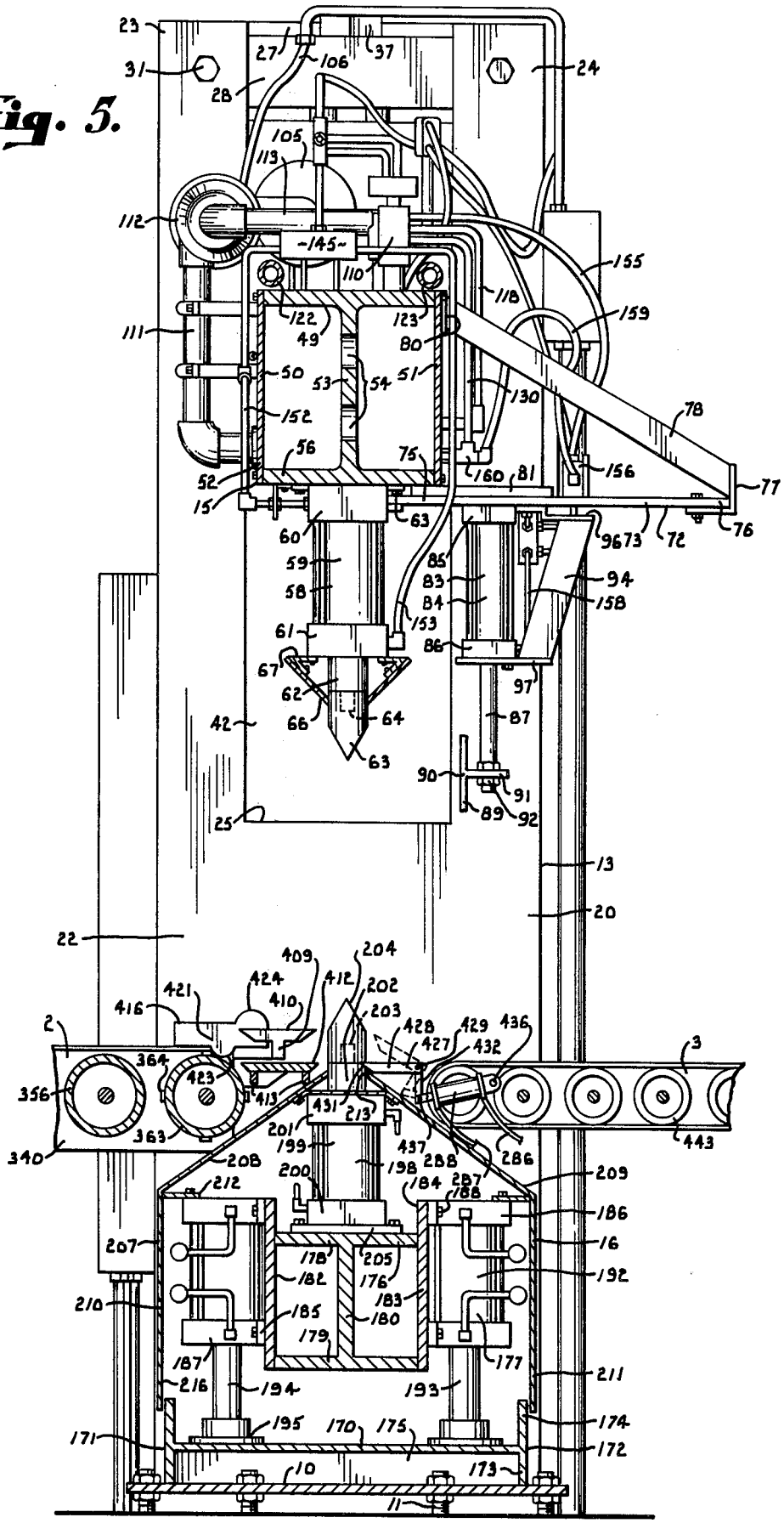
FIG. 5 is a transverse sectional view of the stone splitting apparatus and showing interior details thereof and taken along line 5—5, FIG. 3.

The power line 119 extends from the common manifold or line 136 and joins with a power conduit or line 138 connected to valves controlling the upper carriage double acting chisel rams 58. There are preferably six substantially identical four connection, three position, spring centered, solenoid control, directional control valves 141, 142, 143, 144, 145 and 146 shown in neutral position centered by springs when the solenoids are deenergized. A single such directional control valve 141 is connected via extension and retraction lines 148 and 149 to the center chisel ram 70, and the directional control valve 142 is connected via extension and retraction lines 150 and 151 to paired chisel rams on opposite left and right sides first adjacent the center chisel rams 70, each such ram being marked on the cover guard 66 as (2). Likewise, directional control valves 143 and 144, 145 and 146 are connected via separate extension and retraction lines to paired chisel rams 58 respectively marked as (3), (4), and (5) and (6) on the cover guards 66. Thus it will be appreciated that, while energizing the directional control valve 141 effects movement of only the center chisel ram 70, selective actuation of the remaining directional control valves 142 through 146 respectively controls the remaining chisel rams 58 in serially progressing pairs thereof on opposite left and right sides of the center chisel rams 70. It will further be appreciated that, as illustrated in FIGS. 3, 4, and 5, chisel ram extension conduits, generally indicated by numeral 52, are positioned on the front side of the upper carriage 15 and retraction conduits, generally indicated by numeral 153, are on a rear side of the upper carriage 15 for ease of tracing for maintenance and manufacture.

A return line 139 extends from the directional valves 141 through 146 and joins with the return line 128 for passage into the reservoir 52 through the filter 129. Connected to the power line 138 is a power line 155 leading to a four connection, three position, spring centered, solenoid control, directional control valve 156 which, when energized, selectively routes fluid through extension lines 157 and retraction lines 158 to the rams 82 and 83 to move the gauging structure horizontal bar member 90 into and out of the path of a stone slab 4 traveling on the infeed conveyor 2. A reservoir return line 159 extends from the directional control valve 156 and joins the reservoir return line 139 at a reservoir inlet fitting 160 for return to the reservoir 52.

A visual tube gauge 162 indicates the amount of fluid in the reservoir 52 and a filling port 163 and a drain valve 164 are on opposite sides of the reservoir 52.

It will be appreciated that, in operation of the upper carriage hydraulic system, the motor 105 is constantly running and the pumps 109 and 110 continually supply pressurized fluid. Until required for equipment operation, power fluid from the pumps 109 circulates respectively through the relief valve structures 114 and 132 back into the reservoir 52, the valves 114 and 132 being deenergized open to circulate the fluid back into the reservoir 52. In the illustrated example, electrical connections, described below, act upon the various solenoids to route fluid from the low pressure high volume pump 109 through the line 108 through the mechanical check valve 120 and the common manifold or line 136 through the directional control valve 121 and initially move the upper carriage rams 26 and 30 into position relatively close the stone slab 4 for subsequent splitting. It will be appreciated that such movement of the rams 26 and 30 requires great amounts of power fluid yet, as the rams 26 and 30 are called upon only to move the upper carriage without encountering substantial resistance, little pressure is needed. Relatively rapid actuation of the upper carriage chisel rams 58 and the gauging structure rams 82 and 83 is accomplished by the low volume high pressure pump 110 and fluid therefrom is routed through the line 127 through the one way check valve 137 and the common manifold or line 136 into the power line 119 and then through the power line 138 to the directional control valves 141 through 146 and the directional control valve 156. Additionally, low volume, high pressure fluid from the pump 110 flows through the common manifold or line 136 to the directional control valve 121 and then to the upper carriage rams 26 and 30 for the stone cutting stroke. It will be appreciated that immediately prior to the cutting stroke, the rams 26 and 30 are substantially filled with power fluid and are called upon to extend only a short distance compared to the amount of resistance or pressure which must be overcome to split the stone slab 4.

The hydraulic system of the upper carriage 15 is acutated in coordination with the hydraulic system of the lower carriage 16, described below, by suitable means such as electrical or pneumatic. In the illustrated structure, electrical actuation means for both upper and lower carriages 15 are employed as described below in conjunction with description of the overall electrical system.

The lower carriage 16 is mounted between the lower portions of the upright columns 13 and 14 and in vertically aligned, juxtaposed relation to the upper carriage 15. The lower carriage 16 is mounted upon and supported by the base 110 and has an inner, elongate, rigid, horizontal plate 170 with front and rear margins normally connected to horizontally elongate front and rear vertical members 171 and 172 having respective leg portions 173 engaged upon the base 10 and upper free arm portions 174. A plurality of web stiffeners 175 extend between the base 10 and an under surface of the horizontal plate 170 for rigidly supporting the plate 170 relative to the base 10.

A main beam 176 is upwardly spaced in parallel relation to the horizontal plate 170 and is movably mounted by a plurality of double-acting lower carriage rams 177, described below. The main beam 176, such as an I-beam or H-beam, has wide upper and lower horizontal flanges 178 and 179 connected by a web 180. Elongate front and rear walls 182 and 183 are secured, as by welding, to respective margins of the upper and lower flanges 178 and 179, each wall 182 and 183 having an upper arm portion 184 extending above the upper flange 178. In the illustrated example, the carriage rams 177 each have extension and retraction end caps 186 and 187 and are respectively mounted to the front and rear walls 182 and 183 for vertical reciprocating movement of the main beam 176. The end caps 186 and 187 each have flanges 185 connected to the respective walls 182 and 183, as by bolts 188, FIG. 5. Preferably, the upper and lower carriages 15 and 16 apply equal force to split a stone slab evenly, the carriage rams 26 and 30 of the upper carriage 15 having the same total volumetric capacity as the carriage rams 177 of the lower carriage 16. In the illustrated example, rams 26 and 30 have a 36 inch full stroke in order to accept the stone slabs 4 of substantial thickness. During stone cutting operations, the carriage rams 26 and 30 and the lower carriage rams 177 are limited to a 3 inch stroke and spaced so that there is at least a one inch separation between the upper and lower chisels, described below, so that the chisels do not forceably interengage. The exemplary rams 26 and 30 each have a twelve inch inside diameter cylinder with a three inch stroke, thereby comprising a combined volumetric capacity of 678.58 cubic inches. Correspondingly, there are eight lower carriage rams 177 each with a six inch inside diameter cylinder and a three inch stroke, thereby comprising an according 678.58 cubic inches.

The exemplary lower carriage rams 177 comprise four front rams 190 mounted to the front wall 182 on a main beam 176 and four rear rams 191 mounted on the rear wall 183 on the main beam 176. Each ram 177 has a cylinder 192 and a vertically reciprocable piston shaft 193 with a lower end 194 connected to a foot 195 for distribution of force on the horizontal plate 170.

Mounted along the upper surface of the upper flange 178 of the main beam 176 are a plurality of lower carriage double acting chisel rams 198 vertically aligned with the upper carriage chisel rams 58 for opposed cutting action. There are preferably 11 chisel rams 198 to accord with the upper carriage chisel rams 58. Each of the chisel rams 198 includes a cylinder 199, extension and retraction end caps 200 and 201, and an extensible piston shaft 202. A piston shaft free end 203 has a removable and replaceable tip or chisel 204 thereon for engagement with the stone slab 4. A flange or plate 205 is mounted parallelly to the extension end cap 200 and is affixed to the beam upper flange 178 by suitable fasteners such as bolts.

A cover or guard 207 extends over the lower carriage 16 and has front and rear upwardly convergingly angled top walls 208 and 209 joined with the vertical, spaced, front and rear walls 210 and 211 and connected to the extension end caps 186 of the front and rear carriage rams 190 and 191 by brackets 212 for movement therewith. Vertical openings 213 at the apex or juncture of the front and rear angled top walls 208 and 209 from the chisels 204 and piston shafts 202 to pass therethrough. Lower portions 216 of the front and rear vertical walls 210 and 211 fit over the outside surfaces of the front and rear vertical members 171 and 172 when the main beam 176 is in a lowermost position.

Figure 12:
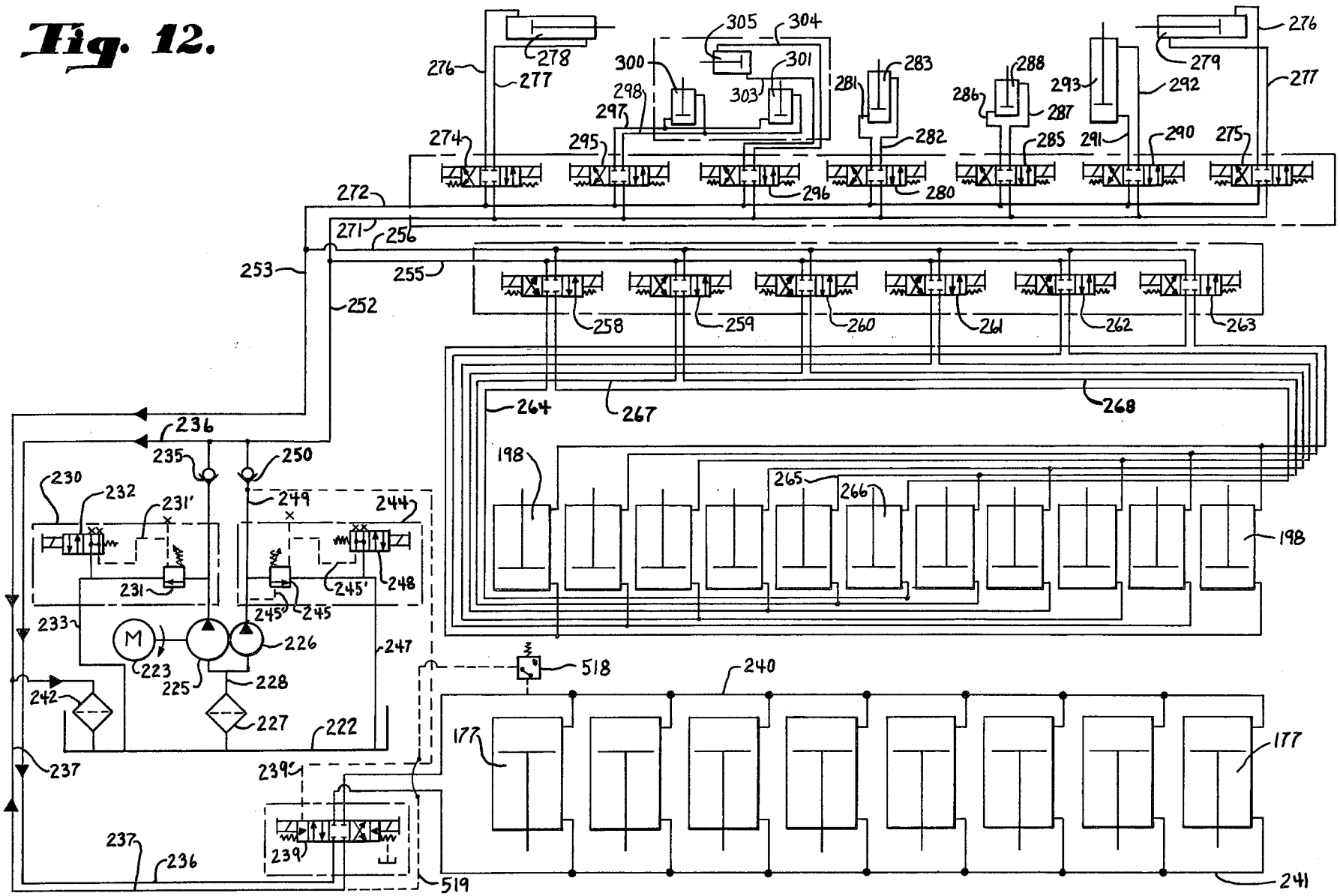
FIG. 12 is a diagrammatic view using ANSI symbols of power fluid components of a lower carriage of a stone splitting apparatus and showing relationship thereof.
Figure 13:
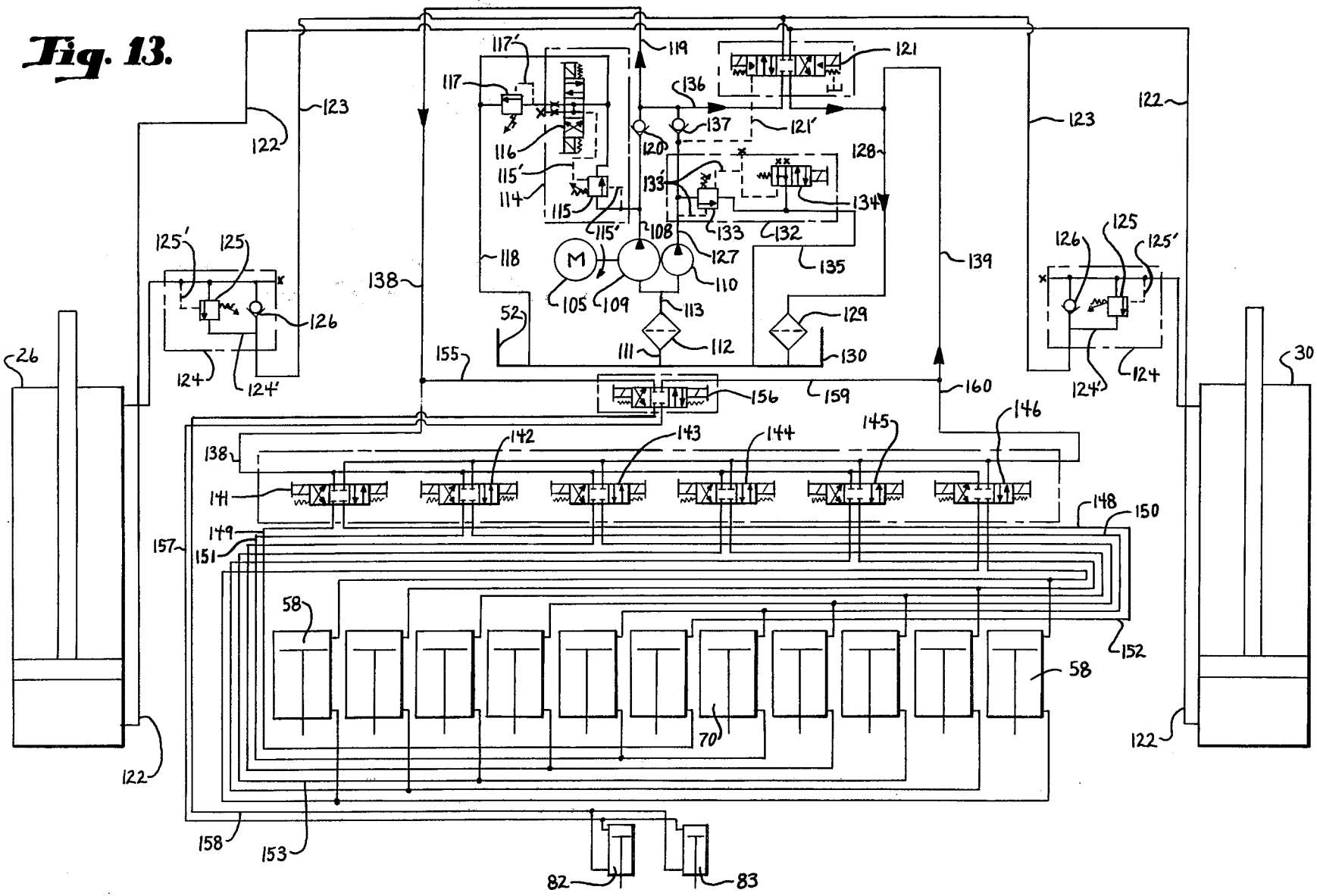
FIG. 13 is a diagrammatic view using ANSI symbols of power fluid components of an upper carriage of a stone splitting apparatus and showing relationships thereof.

The motor and pumps of the lower carriage hydraulic power fluid system, unlike that of the upper carriage 15, are mounted upon a base 218 adjacent the upright column 13 and secured to the floor by suitable fasteners such as J-bolts 219. Referring to FIGS. 3, 5 and 12, positioned atop structure forming a reservoir 222 is an electrical motor 223 connected to a source of electrical power as described below. The motor 223, through a shaft within a housing 224 drives a low pressure, high volume pump 225 and a high pressure, low volume pump 226 corresponding in volume and pressure output to the upper carriage pumps 109 and 110.

The respective pumps 225 and 226 draw hydraulic fluid from the reservoir 222 through a filter 227 and then via the power line 228 to the pumps 225 and 226. Fluid from the low pressure, high volume pump 225 flows through a solenoid controlled relief valve structure 230 internally having an integrally adjusted spring-loaded relief valve 231 with a pilot port line 231' connected to a solenoid-control, spring offset, 2 position, 2 connection, relief valve 232. When open, the relief valve structure 230 permits fluid from the pump 225 to circulate therethrough and to a return line 233 to the reservoir 222. When the directional control valve structure 230 is closed, fluid from the pump 225 travels through a one-way, mechanical, ball and seat check valve 235 preferably open at 250 psi and into a common manifold or line 236. Similarly, fluid from the high pressure, low volume pump 226 travels through a power line 249 to a relief valve structure 244 corresponding to the relief valve structure 230 and internally having a spring-loaded relief valve 245 with a pilot port line 245' connected to the power line 249 and to a solenoid-control, spring offset, 2 position, 2 connection relief valve 248. Deenergized open, the relief valve structure 244 normally routes fluid through a return line 247 to the reservoir 222. Energized closed, the directional control valve structure 244 permits fluid to pass through the power line 249 and a one-way, mechanical, ball and seat check valve 250, preferably set to open at 250 psi, and into the common manifold or line 236. A common return line 237 routes fluid back from rams, described below, through a filter 242 and into the reservoir 222.

Power and return lines 255 and 256 are respectively connected to the common power and return lines 252 and 253 and lead to the lower carriage chisel rams 198. Preferably, there are six identical four connection, three position, spring centered solenoid control directional control valves 258, 259, 260, 261, 262 and 263 corresponding to the upper carriage chisel ram directional control valve 141 through 146. Likewise, a single directional control valve 258 is connected via extension and retraction lines 264 and 265 to a center lower carriage chisel ram 266, and the directional control valve 259 is connected via extension and retraction lines 267 and 268 to paired chisel rams 198 on left and right opposite sides first adjacent the center chisel ram 266, each such ram 198 being vertically paired with an upper carriage chisel ram 58 marked (2) on the cover guard 66. Likewise, directional control valves 260, 261, 262, and 263 are connected via separate extension and retraction lines to paired chisel rams 198 respectively vertically paired with upper carriage rams 58 marked (3), (4), (5) and (6) on the cover guard 207. Thus, in accord with operation of the upper carriages or rams 58, the actuation of the directional control valves 258 effect movement of only the center chisel rams 266 and selected actuation of the remaining directional control valves 259 and 263 respectively move the remaining chisel rams 198 in serially progressing order on left and right opposite sides of the center chisel ram 266. It will be appreciated that, as illustrated in FIG. 5, chisel ram extension lines or conduits are positioned on the front side of the lower carriage 16 and retraction lines or conduits are on a rear side thereof for ease of maintenance and construction.

Power and return lines 271 and 272 are connected to lines 252 and 253 and lead to rams for actuation of auxiliary devices associated with the stone splitting apparatus 1. In the illustrated example and as described below, four connection, three position, spring centered solenoid control directional control valves 274 and 275 are connected to the power and return lines 271 and 272 and have respective extension and retraction lines conduits 276 and 277 extended to rams 278 and 279 for centering stone slabs 4 between the columns 13 and 14 preparatory to cutting or splitting.

A four connection, three position, spring centered, solenoid control, directional control valve 280 is connected to the power and return lines 271 and 272 and has extension and retraction lines conduits 281 and 282 extending therefrom and to a ram 283 for raising a turntable described below, connected to the in-feed conveyor 2 for raising the stone slab 4 thereon.

Another four connection, three position, spring centered, solenoid control, directional control valve 285 is connected to the power and return lines 271 and 272 and with extension and retraction lines 286 and 287 leading to a ram 288 for actuating a flipper mechanism, described below, connected to the outflow or discharge conveyor 3 adjacent the lower carriage 16 for removing cut stones or veneer 5.

Yet another four connection, three position, spring centered, solenoid control, directional control valve 290 is connected to the power and return lines 271 and 272 with extension and retraction lines or conduits 291 and 292 leading to a ram 293 for elevating a portion of the outflow conveyor 3 as described below.

Further, four connection, three position, spring-centered, solenoid control, directional control valves 295 and 296 are connected to the power and return lines 271 and 272 for actuation of a walker beam arrangement having horizontal and vertical coordinated movement for properly positioning stone slabs 4 between the upper and lower carriages 15 and 16. Extension and retraction lines 297 and 298 lead from the directional control valve 295 and extend to spaced rams 200 and 301 providing vertical movement for the walker beam arrangement. Extension and retraction lines 303 and 304 lead from directional control valve 296 and extend to a ram 305 providing horizontal movement.

Connected to the common power and return lines 236 and 237 is a four connection, three position, spring-centered solenoid control, directional control valve 239 with a drain connection and corresponding in operation to the directional control valve 121. A pilot pressure line 239' extends therefrom to the low volume, high pressure power line 249 forwardly of the check valve 250 for pilot operation of the valve 239 for retraction of the rams 177. Power and retraction lines 240 and 241 are connected to appropriate ports in the lower carriage rams 177. The retraction line 241 from the rams 177 to the directional control valve 239 control operation thereof. The fluid back through the reservoir return line 237 and back into the reservoir 222 through the filter 242.

A carriage over travel or safety pressure switch 518 is connected to the power line 240, such as in a Tee-fitting, and includes an adjustable fluid pressure actuated electrical switch to break an electric circuit at a set hydraulic pressure drop. In the illustrated example, the pressure switch 518 senses an abrupt drop in line pressure which occurs as the stone slab 4 being cut finally splits. Fluid is immediately vented via line 519 to the reservoir 222 and electrical connection is made to deenergize the solenoids of the directional control valves 121 and 239 and allow the springs thereof to move port connections from registration, thereby stopping movement of the upper and lower carriages 15 and 16.

A visual tube gauge 307 indicates the amount of fluid in the reservoir 222. A filling port 308 is on a rear side of the reservoir 222.

A gauge panel 311 is mounted to the side of the upright column 13 and has a plurality of gauges 312 thereon connected to corresponding power fluid lines for indicating output pressure of the upper carriage pumps 109 and 110, the lower carriage pumps 225 and 226, the upper carriage rams 26 and 30 and the upper and lower carriage chisel rams 58 and 177. A control gauge 313 adjacent the panel 311 senses preset maximum pressure for the upper and lower carriage and chisel rams 58 and 177 for engagement with the stone slabs 4 preparatory to splitting. In the illustrated example, the upper and lower carriage high pressure, low volume pumps 110 and 226 preferably run at up to 2650 psi line pressure. The upper and lower carriages chisel rams 58 and 198 respectively exert up to 125 psi to penetrate and set against relatively soft shale or weathered surfaces on the stone slab 4 and respectively firmly engage the stone. For example, 125 psi can be set on the control gauge 313 and each selected chisel ram 58 and 198 will extend to exert such pressure upon the stone slab 4. Once firm engagement is effected an electric signal is sent to close the selected chisel ram solenoids 114 through 146 and 258 through 263 and hydraulically lodge the respective extended piston shafts 62 and 202 into engagement with the stone slab 4. Then, the upper carriage rams 26 and 30 and the lower carriage rams 177 are actuated to move the upper and lower carriages 15 and 16 together and split the stone slab 4 therebetween.

Preferably, the upper and lower high volume, low pressure pumps 109 and 225 run at up to approximately 500 psi line pressure and are used to move the upper carriage rams 26 and 30 and the lower carriage rams 177 generally into position above and below the stone slab 4. For the cutting or splitting stroke, the low volume high pressure pumps 110 and 226 pump fluid into the upper carriage rams 26 and 30 and the lower carriage rams 177 and exert up to approximately 600,000 psi on each carriage 15 and 16, thereby comprising a total cutting or splitting force of 1,200,000 psi therebetween.

As described above, in-feed and out-flow or discharge conveyors 2 and 3 are positioned on opposite sides of the stone splitting apparatus 1 for transporting quarried stone blocks or slabs 4 thereto and for removing the slabs 4 after cutting into building stone or veneer 5. In the illustrated example, FIG. 1, the in-feed conveyor 2 has first and second sections 316 and 340 comprising elongate, raised platforms. The conveyor section 316 has spaced opposite side beams 317 supported above the floor by legs 318 with a plurality of transverse rollers 320 mounted between the side beams 317 by axles 319 with bearing supports 321 therefor connected to an upper surface 322 of each side beam 317, as by bolts 323. Relatively large diameter rollers 325 alternate with rollers 326 of comparatively smaller diameter to provide support for a flexible mesh belt 328 of interconnected flat chain lengths, FIG. 6. The flexible mesh belt 328 extends across each of the transverse rollers 320 and frictionally engages at least the upper surfaces 329 thereof. A drive means is connected to an end roller 330 with an axially mounted sprocket 331. In the illustrated example, an electric motor 333 is positioned adjacent and below the end roller 330 atop an arm or bracket 334 on one of the legs 318. A cord 335 extends to a power source, described below. A sprocket 336 is connected to the electric motor 333 and an endless chain 337 is engaged on the sprockets 331 and 336 in driving relation. Preferably, the motor 333 is reversable for changing the direction of movement of stone slabs 4 and is variable in speed, for example from 2 feet per minute to 22 feet per minute.

Figure 8:
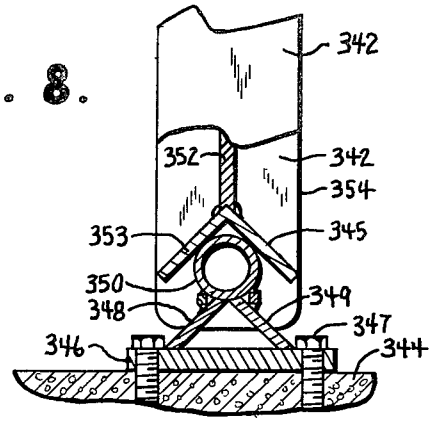
FIG. 8 is a fragmentary enlarged view of a mounting structure for connecting legs of the in-feed and discharge conveyors to a base member.

The infeed conveyor second section 340 adjoins the stone splitting apparatus 1 and has elongate, parallelly spaced opposite upper and lower side beams 341 and 354 supported by vertical legs 342. To provide flexing movement as heavy stone slabs 4 move thereover, each of the legs 342 is connected to the floor 344 by a pivotal mount 345, FIG. 8, permitting tilting of the leg 342 toward and away from the stone splitting apparatus 1. In the illustrated example, a plate member 346 is connected to the floor 344 as by J-bolts 347. Angularly arranged, spaced legs 348 and 349 have lower ends connected to the plate member 346 and are joined at respective upper ends with a transversely aligned, horizontal cylindrical member 350. Each leg 342 includes a flange member 352 extending downwardly therewith and having angularly arranged legs 353 and 354 connected thereto which tiltably engage the cylindrical member 350.

Figure 2:
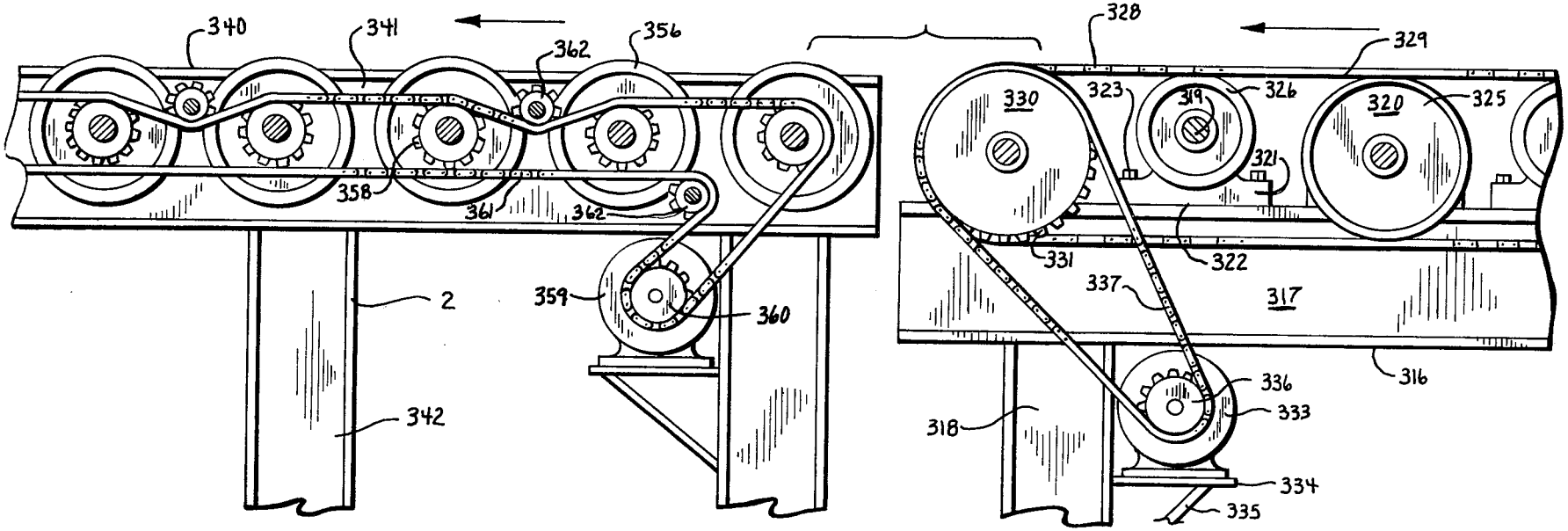
FIG. 2 is a fragmentary, enlarged view of the opposite side of in-feed conveyor from that shown in FIG. 1.
Figure 6:
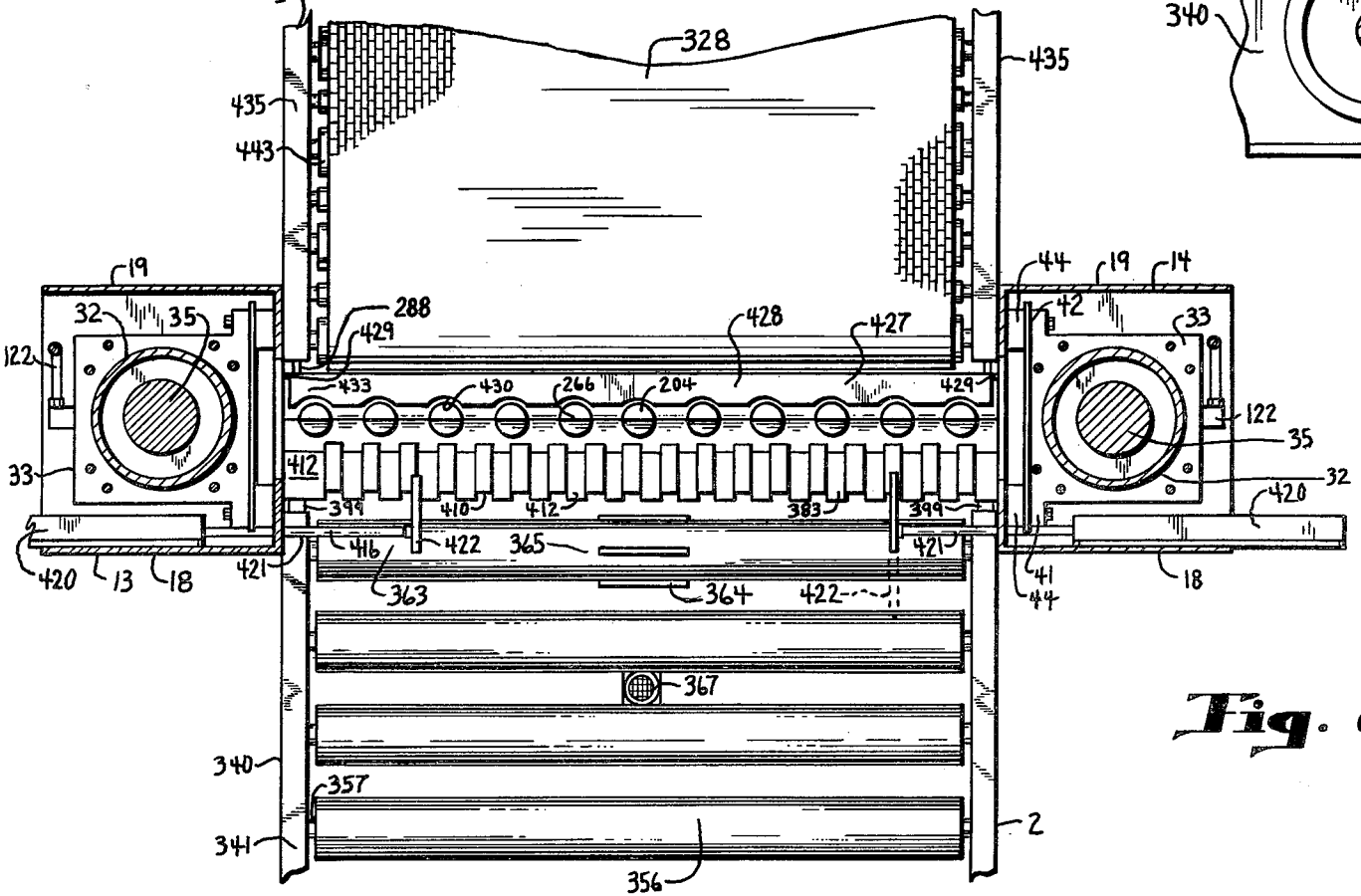
FIG. 6 is a fragmentary sectional view of the stone splitting apparatus taken along lines 6—6, FIG. 4 and showing details of centering ram structures and in-feed and discharge conveyors.

A plurality of rollers 356 extend transversely between the upper side beams 341, FIGS. 2 and 6 and have respective axle shafts 357 rotatably received in bearing supports mounted in the side beams 341. Each of the rollers 356 includes a sprocket 358 driven by a chain 361 engaged with the respective sprockets 358 and a sprocket 360 mounted to a motor 359, such as having variable speed and reversable drive. Additionally, sprockets 362 connected to a side beam 341 maintain tension on the chain 361. The drive arrangement of the second conveyor section 340 is preferably reversable to move stone slabs 4 either toward or away from the stone splitting apparatus 1 and variable in speed from approximately two feet per minute to twenty-two feet per minute for controlling the rate of movement of the stone slabs 4.

An end roller 363 adjoining the stone cutting apparatus 1, FIG. 6, has a plurality of spaced ribs 364 mounted longitudinally around the periphery of a midportion 365 of the roller 363 for engaging and pushing the stone slab 4 between the chisels of the upper and lower carriages 15 and 16.

Figure 7:
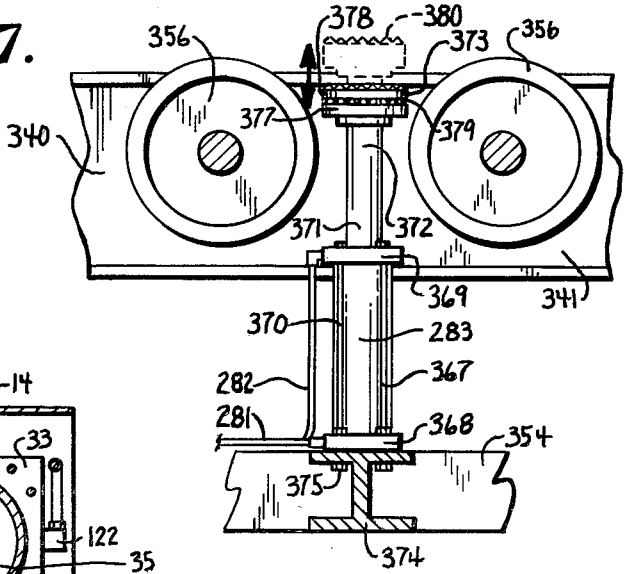
FIG. 7 is a fragmentary enlarged view of a portion of the in-feed conveyor and showing a selectively extensible and retractable turntable structure.

A turntable device 367, FIG. 7, is mounted in the second conveyor section 340 for elevating a stone slab 4 or a portion thereof and permitting an operator to manually turn the slab to a desired orientation for cutting or splitting. The exemplary turntable device 367 includes the ram 283 having a cylinder 370 with extension and retraction end caps 368 and 369 mounted at opposite ends thereof and respectively connected to the extension and retraction power fluid lines 281 and 282 as described in connection with FIG. 12. A piston shaft 371 for upward movement between adjacent transverse rollers 356 has a free end 372 with a turntable 373 mounted thereon. The device 367 is mounted upon a beam member 374 which extends transversely between the lower side beams 354, the ram extension end cap 368 being connected to a middle portion thereof as by bolts 375.

The exemplary turntable 373 has a lower plate portion 377 fitted atop the piston shaft free end 372 and an upper plate portion 378 rotatably mounted atop the lower plate portion 377, as by a plurality of ball bearings 379. The upper plate portion 378 includes an outer surface having a plurality of tooth-like projections 380 for engaging the lower surface of a stone slab 4 as it travels over the turntable device 367. The turntable upper plate portion 378 is relatively small compared to the size of most stone slabs 4 and only a small portion of the stone slab need be lifted from contact with the upper surface of the transverse rollers 356. It is normally sufficient that only one side or corner of the stone slab 4 be lifted by the turntable device 367 for manually turning the stone slab 4 by the operator.

Figure 10:
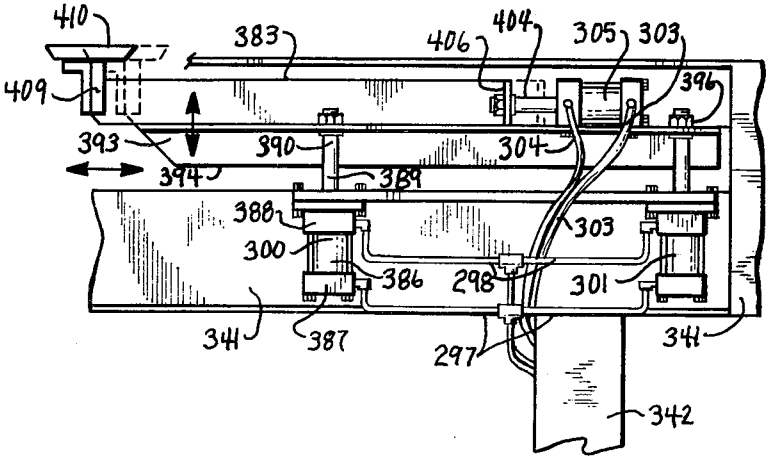
FIG. 10 is a fragmentary enlarged view of a walker beam structure positioned in front of chisels of a stone splitting apparatus lower carriage and controllably move stone slabs into position for splitting and showing upward and forward positioning thereof.
Figure 11:
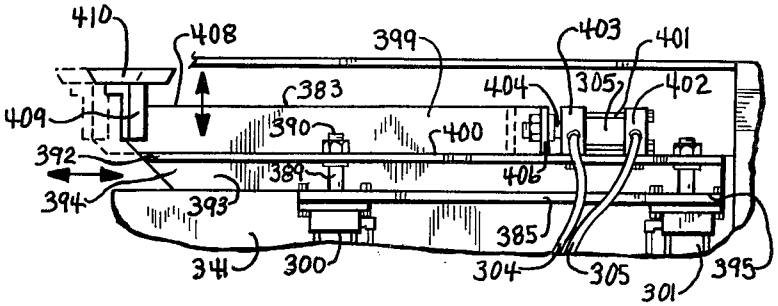
FIG. 11 is a fragmentary enlarged view of the walker beam structure and showing downward and rearward positioning of same.

As the stone slab 4 is carried by the second conveyor section 340 and approaches the stone splitting apparatus 1, the ribs 364 on the end roller 363 push the stone slab 4 onto a walker beam arrangement 383, FIGS. 10 and 11, positioned at the forward end of the parallel spaced side beams 341. The I-beams 341 include an inwardly extending flange portion 385 to which vertically directed, spaced rams 300 and 301 are connected such as in longitudinally aligned relationship. The rams 300 and 301 each include a cylinder 386 having extension and retraction end caps 387 and 388 with a vertically reciprocable piston shaft 389. Respective piston shaft free ends 390 are connected to a flange portion 392, as by nuts 396, of an angle beam 393 for vertical reciprocation toward and away from the respective conveyor side beam 341. The angle beam 393 includes a downward web portion 394 with a lower or bottom edge 395 for contacting the upper surface of the conveyor side beam 341 when the angle beam 393 is in a lowermost position, FIG. 11.

A second beam 398 is positioned atop the angle beam 393 for horizontal reciprocation and includes an elongate, horizontally extending bar 399 having a lower or bottom edge 400 slidably resting upon the upper surface of the flange portion 392 of the angle beam 393. The ram 305 is mounted atop the angle beam flange portion 392 in horizontal alignment with the second beam 398 and includes a cylinder 401 with extension and retraction end caps 402 and 403 and a horizontally reciprocable piston shaft 404 connected to a right angle bracket portion 406 of the bar 399. A forward end 408 of the bar 399 is connected to an end of an elongate, horizontal bar member 409 extending transversely across the end of the second conveyor section 340 adjacent the lower carriage chisels 204. A plurality of spaced, parallel fingers 410 are mounted atop the bar member 409 for vertical and horizontal reciprocation therewith as the respective angle beams 393 and second beams 398 move vertically and horizontally. The row of fingers 410 alternate in side-by-side relationship with a row of stationary fingers 412 mounted on front and rear bar members 413 extending transversely of the end of the second conveyor section 340 and connected to opposite inner end walls 20 of the columns 13 and 14, FIG. 5. The movable row of fingers 410 are positioned slightly below the stationary row of fingers 412 so that the movable row of fingers 410 can be moved either forwardly or rearwardly with respect to the stationary row of fingers 412 without contacting the lower surface of the stone slab 4 and then lift the stone for moving the same either forwardly or rearwardly so as to selectively position a stone slab 4 between the chisel in proper relation for cutting or splitting.

Power fluid extension and retraction 297 and 298 and 303 and 304 are connected to the conduits or lines 271 and 272 through the respective solenoids 295 and 296 as described above in connection with FIG. 12. The walker beam arrangement 383 is suitably connected to electrical control means, described below, for forward and reverse movement to move a stone slab 4 toward and away from the lower carriage chisels 204, such movement being automatically or semi-automatically as selected.

Also aiding in positioning the stone slab 4 for cutting are left and right centering devices 416 mounted to each of the upright columns 13 and 14 in opposed relation and selectively operable to center the stone slab 4 between the center or number 1 chisel rams 70 and 266. The centering devices 416 each include the rams 278 and 279 each having including extension and retraction end caps 417 and 418 and a cylinder 419 with the extension and retraction lines 276 and 277 suitably connected to the extension and retraction end caps 417 and 418. The rams 278 and 279 are mounted to the upright columns 13 and 14 on horizontal elongate beam members 420 respectively secured, as by welding, to the inner surface of the front side wall 18 and to the cylinder 419. A reciprocable piston shaft 421 has a member for engaging the stone slabs 4, such as an elongate pusher plate 422, affixed to the free end of the shaft 421. In the illustrated example, the piston shaft 421 is connected adjacent one edge of the pusher plate 422 so that the plate 422 can be flipped forwardly and a curved projection 423 slidably rest upon the surface of the end roller 363. Alternatively, the pusher plate 422 can be flipped rearwardly and a curved projection 424 at the other end thereof slidably rest upon a roller 356 positioned rearwardly of the end roller 363, thereby permitting selective pivoting of the pusher plate 422 for placement against the sides of the stone slab 4.

The power fluid extension and retraction conduits 276 and 277 for each of the rams 278 and 279 are respectively connected to solenoid actuated directional control valves 274 and 275 as described in connection with FIG. 12. Suitable electrical control means permit selective extension and retraction of each of the rams 278 and 279 for control of each centering device 416.

A flipper device 427 having a normally horizontal, elongate bar member 428 extends transversely between the upright columns 13 and 14 and has opposite ends connected to the opposite column walls 21, as by pins 429, for upward or flipping rotation in a vertical plane. A forward edge of the bar member 428 includes a plurality of inwardly curved recesses 430 for accommodating the lower carriage chisel ram shafts 202 and the forward edge 431 is angled to rest against the cover guard 209. An arm 432 depends normally from an end 433 of the bar member 428 for pivotal connection to the ram 288 which in turn is pivotally connected an outflow conveyor side beam 435 by a pivot connection 436. The other end of the ram 288 has a pivot connection 437 to a free end of the arm 432 thereby comprising a crank arrangement between the bar member 428 and the ram 288 which causes the bar member 428 to rotate upwardly, or flip, upon extension of the ram 288 and return to a substantially level position upon retraction of the ram 288, as for removing the cut or split stone or venner 5 after cutting by the stone splitting apparatus 1 and flipping the stone onto the outflow conveyor 3.

Extension and retraction conduits or lines 286 and 287 are connected to the solenoid actuated directional control valve 285 for selected operation after cutting of the stone slab 4. Suitable electrical control lines extend to a central control panel as described below.

The discharge conveyor 3 includes a stationary first conveyor section 440 and a movable second conveyor section 441 for directing the stone veneer 5 either to the left or right of the first conveyor section 440 and for moving the veneer blocks 5 upwardly for loading into an elevated truck or container. The stationary first conveyor section 440 includes parallel spaced side beams 435 and lower side beams 454, legs 342 and pivotal mounts 345 as described in connection with the end feed conveyor second section 340. A plurality of transverse rollers 443 are rotatably connected between the side beams 435 for travel of the blocks of veneer 5 thereover. A flexible mesh belt 328 of interconnected chain links encircles the rollers 443 for transport of the veneer blocks 5. A motor 444 is positioned on a mount 445 at one end of the first discharge conveyor section 440 and is connected by a sprocket and drive arrangement (not shown) to an end roller 446.

The movable second discharge conveyor section 441 includes a frame 448 having front and rear pivotal wheels 449 and 450 and floor engaging adjustable feet 451 for positioning the second discharge conveyor section 441 in a selected orientation to the first discharge conveyor section 440. The conveyor section 440 includes parallel spaced side beams 452 having a plurality of transverse rollers and a flexible mesh belt thereon as described in connection with the first discharge conveyor section 440. An end portion 454 is pivotally connected, as by pins 456, to standards 455 extended upwardly from an end of the frame 448 adjacent the second discharge conveyor section 441 for movement of veneer blocks 5 from one section to another. A motor 457 is positioned upon a mount 458 and a chain drive arrangement is connected to an end roller for rotation of the mesh belt.

The ram 293 has opposite ends with pivotal connections 459 and 460 respectively on the frame 448 and on a forward portion of the second conveyor section side beams 452 for raising and lowering of the side beams 452 and the rollers and mesh belt carried therewith upon extension of the ram 393.

Extension and retraction conduits or lines 291 and 292 are connected to the solenoid actuated directional control valve 290 for positioning of the second discharge conveyor section 441 using an operators control panel as described below.

Figure 14:
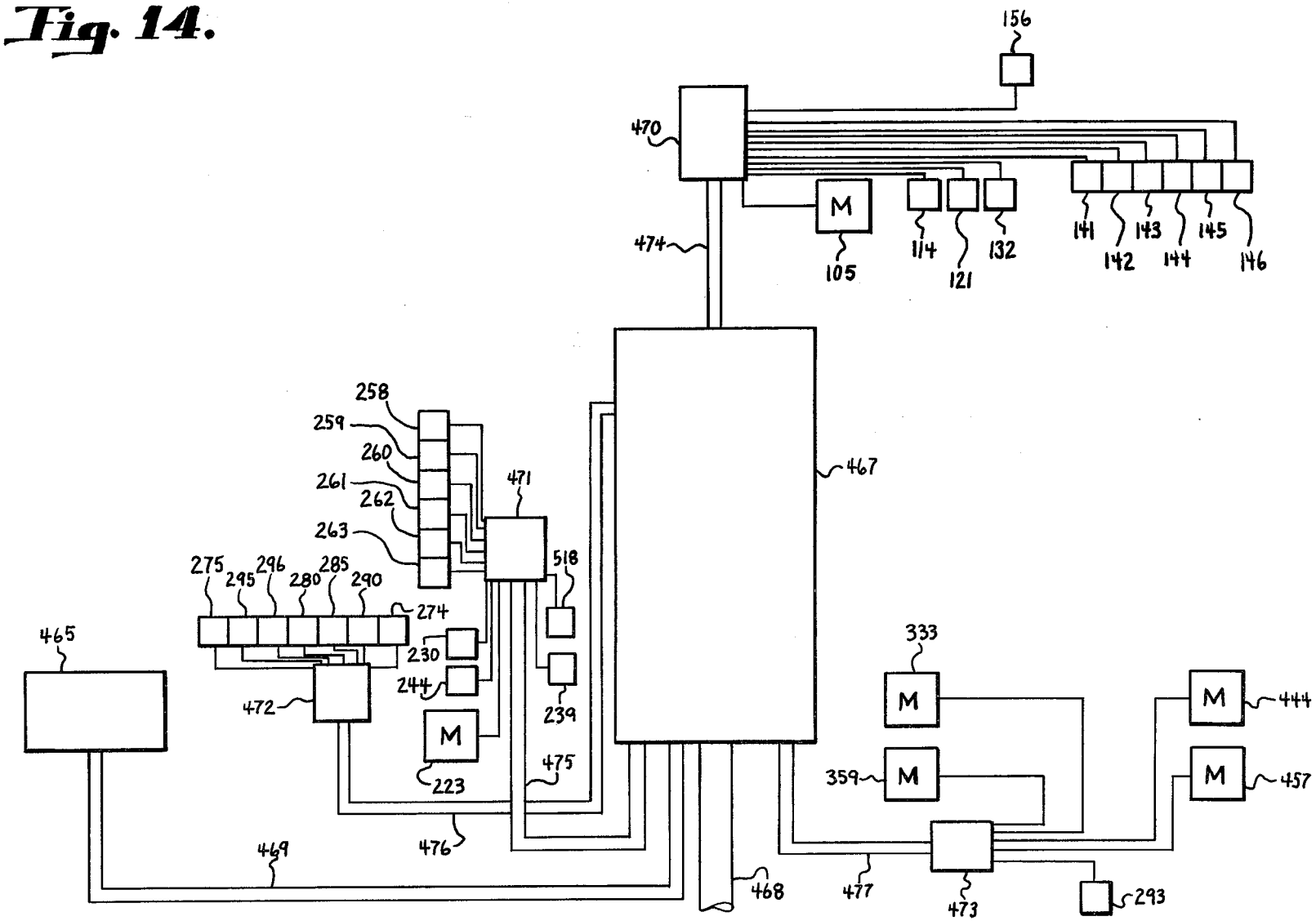
FIG. 14 is a diagrammatic view of electrical circuitry and related components of the stone splitting apparatus.
Figure 15:
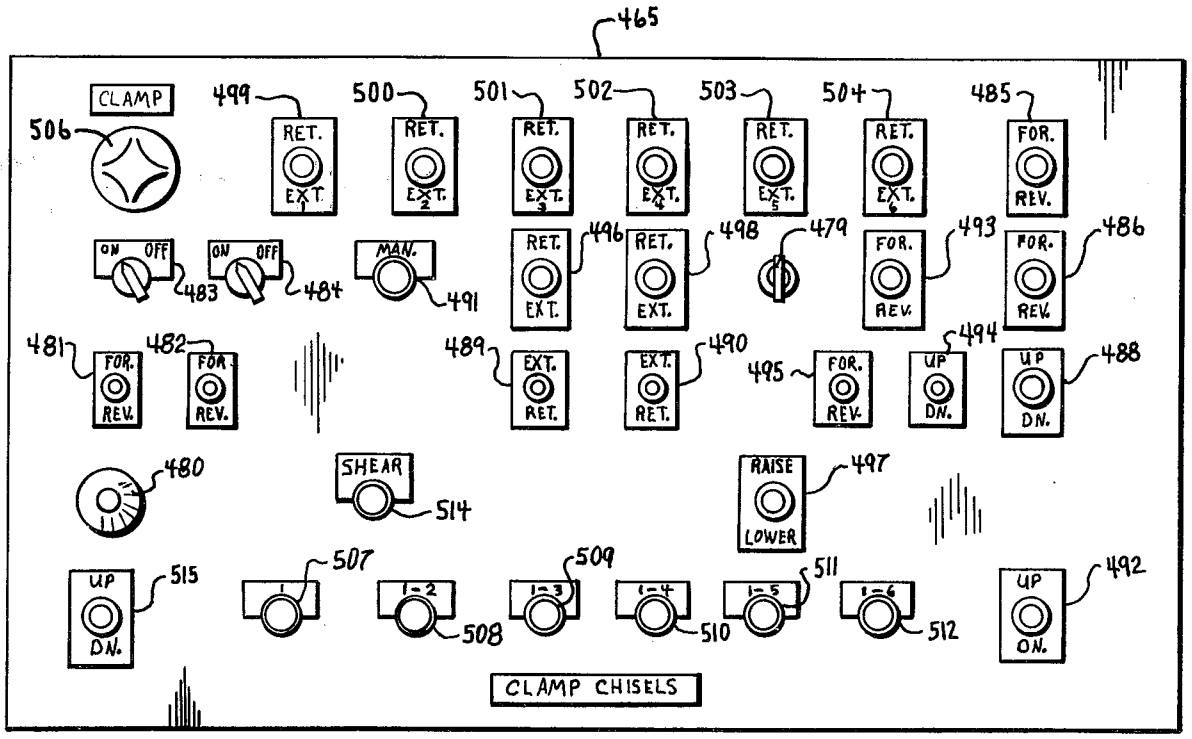
FIG. 15 is an enlarged plan view of an operator's control panel for the stone splitting apparatus.

In the illustrated example, the stone splitting apparatus 1 and the end feed and outflow conveyors 2 and 3 are electrically controlled and include an operators control panel 465, FIGS. 14 and 15 having a plurality of switches thereon operably connected to circuitry for controlling the various solenoid actuated power fluid valves and motors described above. The control panel 465 is preferably mounted on a stand adjacent the second in-flow conveyor section 340 and the stone splitting apparatus 1 so that the operator may oversee the operation and properly position the stone blocks or slabs 4 for cutting or splitting.

The electric control means, FIG. 14, includes a main relay box 467 having an electrical cable 468 extending therefrom to a source of power (not shown). The operator's control panel 465 is connected to the main relay box by a cable 469 and controls electrical power to an upper carriage and electrical relay box 470, lower carriage electrical relay boxes 471 and 472 and a conveyor electrical relay box 473 which are suitably connected to the main relay box 467 by cables 474, 475, 476 and 477.

The operator's control panel 465 includes a key operated off-on main power switch 479 and an emergency "kill" quick shut-off button 480 which removes electrical power from all the solenoids and motors. Toggle switches 481 and 482 respectively control forward and reverse movement of the first and second in-feed conveyor section 316 and 340 and switches 483 and 484 respectively turn on and off the upper and lower carriages motors 105 and 223. Toggle switch 485 controls movement of the first and second discharge conveyors 440 and 441 and the discharge conveyor lifting or raising ram 293 is controlled by the switch 486.

A turntable up and down toggle switch 488 controls actuation of the turntable ram 383 to elevate selected stone slabs 4 for positioning by the operator as they travel on the conveyor toward the upper and lower rows of chisels. As the stone slabs 4 approach the rows of opposed chisels, the operator actuates respective left and right centering pusher rams 278 and 279 by left and right pusher toggle switches 489 and 490. The material stop rams 94 and 95 are extended and retracted by use of a material stop toggle switch 492. To position the stone slab 4 against the material stop 72, use of the walker beam arrangement 383 is provided. A walker beam forward and reverse toggle switch 493 actuates circuitry providing automatic cycling movement of the row of movable fingers 410 relative to the stationary row of fingers 412 for lifting the stone slab 4 and moving the same either forwardly or rearwardly as selected. Alternatively, the walker beam rams 300 and 301 providing vertical or lifting movement of the walker beam arrangement is selectively actuated by a toggle switch 494 and the ram 305 providing forward and reverse movement of the walker beam arrangement is selectively actuated by a toggle switch 495.

Toggle switches 496 and 498 respectively control movement of the upper and lower carriages 15 and 16 for extension for inspection and maintenance and to position the upper carriage next to the stone slab 4 in preparation for cutting. Neither switch 496 and 498 are operative unless a manual push-button switch 419 is actuated, thereby requiring the operator to keep both hands on the control panel 465 and away from moving parts of the apparatus 1. For inspection and maintenance, the upper and lower chisel rams 58 and 177 are individually extensible in upper and lower pairs thereof by use of toggle switches 499, 500, 501, 502, 503 and 504.

When the stone slab 4 is correctly positioned between the opposed rows of chisels, the upper carriage rams 26 and 30 are actuated by use of the toggle switch 496 which positions the valve structure 114 and opens the valve 121 to direct high volume, low pressure power fluid into the rams 26 and 30. The upper carriage 15 is lowered until the chisels 63 thereof are slightly above the top surface of the stone slab 4. Next, the operator selects from a series of switches 507, 508, 509, 510, 511 and 512 which of the upper and lower carriage chisel rams 58 and 177 are to be extended. In the illustrated example, switch 507 operates to extend only the center or "1" chisels 70 and 266, switch 508 extends the three chisels marked "1" and "2"; switch 509 the five chisels marked "1", "2" and "3"; and so on until all twenty-two chisels of the respective upper carriage 15 and lower carriage 16 are extended and contacting the respective surface of the stone slab 4.

When the selected chisels seat firmly against the upper and lower surfaces of the stone slab 4 and the rock engagement pressure as set in the control gauge 313 is reached, a light 506 illuminates. The operator then with one hand depresses a button switch 514 marked "Shear" and using his other hand, the operator actuates a toggle switch 497 which routes electrical power to open the valve structures 114 and 230, close the valve structures 132 and thereby route fluid through the valves 121 and 239 to the upper carriage rams 26 and 30 and the lower carriage rams 177 to move the upper and lower carriages 15 and 16 together and split or cut the stone slab between the extended chisels.

To remove the cut stone veneer 5 from adjacent the chisels, the operator actuates a flipper toggle switch 515 which controls the solenoid actuated directional control valve 285 and the ram 288. From there, as described above the veneer block 5 travels along the outflow or discharge conveyors 3 for stacking on a vehicle or storage and ultimate use in the building industry.

It will be appreciated that the apparatus 1 can be embodied in many and varied forms. Accordingly, while one form of the invention has been illustrated and described, it is not to be limited to the specific form or arrangement of parts herein described and shown, except insofar as such limitations are included in the following claims.

What is claimed and desired to secure by Letters Patent is:

1. In a stone cutting apparatus having a cutting position with an introducing conveyor for moving a stone to the cutting position and a removal conveyor for moving cut stone therefrom, a cutting apparatus at said cutting position in transverse relation to said conveyors and having spaced columns and upper and lower carriages with cutting chisels carried thereby, said carriage being movable for cutting stone between the chisels, the improvement being stone positioning apparatus including:

(a) a stop member extending transversely of the removal conveyor;

(b) means adjustably supporting said stop member for selective positioning from the chisels the width of a cut piece of stone;

(c) a turntable under a path of stone on the introducing conveyor for engaging stone approaching the cutting position and facilitating turning of the stone;

(d) a walker apparatus between the introducing conveyor and cutting position and having a plurality of stationary bars laterally spaced apart and extending toward the cutting position and a plurality of movable bars between the stationary bars; and (e) means operatively connected to the movable bars to selectively move the movable bars up and down and toward and away from the cutting position and cooperate with the turntable in maneuvering a stone into engagement with the stop member and in suitable position for cutting a selected piece therefrom.

2. A stone cutting apparatus as set forth in claim 1 and including:

(a) reversing drive mechanism connected to the introducing conveyors and operative for selectively driving same to advance and retract the stone relative to the cutting position and cooperate with the walker apparatus in selectively moving the stone to engage the stop member in selected position.

3. A stone cutting apparatus as set forth in claim 2 and including:

(a) lateral stone pusher members on each side adjacent to the chisels and upstream therefrom relative to the stone path; and (b) power means connected to said pusher members and operative to selectively move same toward and away from a stone to center same in the cutting position and cooperate with the walker apparatus to position a stone to be cut.

4. A stone cutting apparatus as set forth in claim 3 and including:

(a) a flipper device adjacent the chisels and downstream therefrom relative to the stone path; and (b) power means connected to said flipper device and operative to selectively move same to flip the stone downstream from the chisels and deposit same on the removal conveyor.

5. A stone cutting apparatus as set forth in claim 4 and wherein:

(a) the flipper device has opposite ends pivotally mounted to the removal conveyor and an arm secured to said flipper device and extending generally downwardly therefrom; and (b) said power means includes a reciprocable ram having one end swingably connected to the removal conveyor and another end swingably connected to said arm, the ram being retractable to swing the flipper device into a horizontal position and extensible to tilt the flipper device and flip said stone downstream.

6. A stone cutting apparatus as set forth in claim 1 and wherein:

(a) said stop member is mounted to the upper carriage and movable therewith; and (b) the stop member includes a support structure on the upper carriage and an elongate bar movable into an arresting position extending transversely of the rearward conveyor, the bar being extensibly connected to the support structure by a power fluid responsive ram.

7. A stone cutting apparatus as set forth in claim 1 and wherein:

(a) said means adjustably supporting said stop member includes a beam member slidably mounted relative to the upper carriage with movement toward and away thereform for selecting a width of stone for cutting.

8. A stone cutting apparatus as set forth in claim 1 and wherein:

(a) the turntable includes a power responsive ram mounted under the introducing conveyor and extensible for projecting above same; and (b) means mounted to the ram for engaging at least a portion of the stone as the stone moves thereover and lifting said portion above the introducing conveyor.

9. A stone cutting apparatus as set forth in claim 8 and wherein:

(a) the means for engaging a portion of the stone include a rotative device having a lower plate portion affixed to an end of the ram and an upper plate portion rotatably mounted atop the lower plate portion, the upper plate portion having gripping teeth thereon for engaging said portion.

10. A stone cutting apparatus as set forth in claim 1 and wherein:

(a) the stationary bars are supported by a first elongate beam extending thereunder and having opposite ends connected to the introducing conveyor; and (b) the movable bars are supported by a second elongate beam extending thereunder and having opposite ends connected to said means for selectively moving the movable bars.

11. A stone cutting apparatus as set forth in claim 10 and wherein:

(a) said means operatively connected to the movable bars include spaced pairs of movable upper and lower beam members longitudinally mounted to the introducing conveyor with respect to the cutting position, each lower beam member being movably mounted to the introducing conveyor for up and down movement carrying the upper beam members therewith, each upper beam member having an opposite end of the second elongate beam connected thereto, and the upper beam members being movable toward and away relative to the lower beam members;

(b) first power fluid responsive reciprocable rams extending between the lower beam members and the introducing conveyor for moving the lower and upper beam members and the second elongate beam up and down relative thereto; and (c) second power fluid responsive reciprocable rams extending between the upper and lower beam members for moving the upper beam members and the second elongate beam toward and away from the cutting position.

12. A stone cutting apparatus as set forth in claim 1 and including:

(a) a movable conveyor section connected to said removal conveyor and having means moving same from up and down for depositing the cut stone in desired upward locations relative to the removal conveyor.

13. A stone cutting apparatus as set forth in claim 12 and wherein:

(a) the movable conveyor section includes an undercarriage having opposite end portions, spaced side beams having respective paired opposite end portions and an article conveying surface with a conveyor belt structure extending between the side beams; the side beams and article conveying surface overlying the undercarriage;

(b) one of said paired opposite end portions having a pivotable connection to an end portion of said undercarriage for upward swinging movement of said side beam members and said article conveying surface relative to the undercarriage; and (c) a power fluid reciprocable ram extending between said side beam members and the undercarriage for effecting upward swinging of the side beams and article conveying surface relative to the undercarriage.

14. Apparatus for cutting slabs of stone into pieces of selective width comprising:

(a) a cutter apparatus having a base and spaced apart upright columns at each side of a stone path with a cutting position therebetween;

(b) a stone introducing conveyor including a supporting frame, transverse rollers, and conveyor belt structure operative thereover to support stone slabs on a path to the cutting position and reversing drive mechanism operatively connected to the conveyor to selectively advance and retract stone slabs relative to the cutting position;

(c) a discharge conveyor including a supporting frame, transverse rollers and conveyor belt structure operative thereover with drive mechanism operatively connected thereto to receive and move cut stone pieces from said cutting position;

(d) opposed guide ways on said columns;

(e) upper and lower carriages extending between the columns and movably engaged with said guide ways;

(f) extensible rams mounted in the columns and operatively connected to the upper carriage for raising and lowering same;

(g) extensible rams supported relative to said base and operatively connected to the lower carriage for raising and lowering same;

(h) a plurality of chisel rams carried by each of said carriages in closely spaced relation along the length thereof between the carriages with the chisel rams on the upper carriage being in axial alignment with respective chisel rams on the lower carriage;

(i) a chisel extending from each chisel ram and movable thereby toward and away from a stone slab in the cutting position;

(j) a first power output unit including a drive motor connected to at least one power fluid pump with a reservoir therefor mounted to the upper carriage and movable up and down therewith, said pump on the upper carriage operatively connected to the extensible rams in the columns and to the chisel rams carried by the upper carriage;

(k) a second power output unit including drive motor connected to at least one power fluid pump with a reservoir therefor operatively connected to the extensible rams connected to the lower carriage for raising and lowering same and to the chisel rams carried by the lower carriage; and (l) actuation control means operatively connected to the first and second power output units and selectively effecting routing of power fluid to the chisel rams, the extensible rams in the columns and the rams connected to the lower carriage for raising and lowering same; the actuation control means including an operator's control panel for operation of said apparatus.

15. The apparatus set forth in claim 14 and wherein:

(a) said first and second power fluid output units each include high volume, low pressure pumps and low volume, high pressure pumps;

(b) said actuation control means effect routing of power fluid from the high volume, low pump on the upper carriage to the extensible rams in the columns for moving the upper carriage downwardly and adjacent the stone slab and for routing power fluid from the respective high volume, low pressure pumps for engaging the chisels carried by the upper and lower carriages with the stone slab at a preselected pressure insufficient to cut same; and (c) said actuation means effect routing of power fluid from the respective low volume, high pressure pumps to the extensible rams in the columns and the extensible rams operatively connected to the lower carriage for moving the upper and lower carriages and the chisels thereon together to cut the stone slab.

16. The apparatus set forth in claim 15 and including:

(a) means for moving the upper and lower carriages together at an equal rate toward the stone slab for cutting same; and wherein (b) said means include equal volumetric capacity of the extensible rams in the columns and the extensible rams operatively connected to the lower carriage and equal rates of power fluid flow entering the rams.

17. The apparatus set forth in claim 16 and wherein:

(a) the upper carriage includes a horizontal main beam member with upper and lower flanges and having front and rear walls secured to said flanges and defining said reservoir;

(b) the first power output unit being mounted upon the upper flange; and (c) the chisel rams for the upper carriage being mounted to the lower flange in depending relation.

18. The apparatus set forth in claim 17 and wherein:

(a) the extensible arms in the columns respectively include a counterbalancing valve structure each with a body having a ball and seat arrangement therein and a spring biased return relief valve having a conduit connection to a conduit means on a pump side of the ball and seat arrangement body and at least two conduit connections to conduit means on a ram side of the body, one of said ram side conduit connections being registerable with the conduit means on the pump side of the body; and (b) said spring is set to return and register said one ram side conduit connection with the pump side conduit only upon entry of power fluid into said relief valve through the remaining ram side conduit connection having a preselected pressure greater than said spring.

* * * * *